US010260675B2

(12) United States Patent
Miller

(10) Patent No.: US 10,260,675 B2
(45) Date of Patent: Apr. 16, 2019

(54) COLLAPSIBLE SUPPORT BASE FOR VERTICAL POSTS

(71) Applicant: Jumping Targets, LLC, Lehi, UT (US)

(72) Inventor: Jared Miller, Lehi, UT (US)

(73) Assignee: Jumping Targets, LLC, Lehi, UT (US)

( * ) Notice: Subject to any disclaimer, the term of this patent is extended or adjusted under 35 U.S.C. 154(b) by 55 days.

(21) Appl. No.: 15/586,445

(22) Filed: May 4, 2017

(65) Prior Publication Data

US 2018/0320815 A1 Nov. 8, 2018

(51) Int. Cl.
*F16M 13/00* (2006.01)
*F16M 11/38* (2006.01)

(52) U.S. Cl.
CPC ..... *F16M 11/38* (2013.01); *F16M 2200/08* (2013.01)

(58) Field of Classification Search
USPC ..... 248/528
See application file for complete search history.

(56) References Cited

U.S. PATENT DOCUMENTS 30,069 A * 9/1860 Lamb ..... G06F 57/04 211/167
2,188,237 A * 1/1940 Weaver ..... F16M 11/16 248/168
2,706,610 A * 4/1955 Roberts ..... F21L 15/08 248/168
2,786,641 A * 3/1957 Applegate ..... A47G 33/12 248/523
4,648,698 A * 3/1987 Iwasaki ..... F16M 11/105 248/163.1
5,292,101 A * 3/1994 Henson ..... E04H 12/20 248/188.2
5,322,250 A * 6/1994 Wilhite, Jr. ..... F16M 11/38 248/166
5,647,565 A * 7/1997 Wei ..... F16M 11/10 248/168
6,068,224 A * 5/2000 Horiuchi ..... F16M 11/16 248/168
6,102,357 A * 8/2000 Papadatos ..... A47G 33/1226 248/516
6,234,434 B1 * 5/2001 Avinger ..... A47G 33/12 248/188.7
6,254,044 B1 * 7/2001 Lee ..... F16M 11/14 248/163.1
6,505,429 B2 * 1/2003 Percival ..... F41A 23/12 248/163.1

(Continued)

*Primary Examiner* — Monica E Millner
(74) *Attorney, Agent, or Firm* — Travis R. Banta; TechLaw Ventures, PLLC

(57) ABSTRACT

This disclosure relates generally to a support base, which includes a support leg that is rigidly joined to a first connector and a second connector. The first connector includes a post aperture while the second connector also includes a second post aperture. The first connector and the second connector further include a plurality of pinning apertures. The support base also includes a pivotable support leg, which includes a pin that is disposed within one of the plurality of pinning apertures in the first connector and within one of the plurality of pinning apertures in the second connector. In this manner, the support base may be collapsible by pivoting or rotating the pivotable support leg towards the support leg.

18 Claims, 5 Drawing Sheets

(56) References Cited

U.S. PATENT DOCUMENTS

| | | | | |
|---|---|---|---|---|
| 6,601,999 | B1 * | 8/2003 | McTeer | F16M 13/04<br>396/420 |
| 6,695,268 | B1 * | 2/2004 | Hsieh | A47B 19/002<br>248/188.7 |
| 7,490,797 | B1 * | 2/2009 | Law | F16M 11/242<br>248/163.2 |
| 8,858,097 | B2 * | 10/2014 | Hale | F16M 11/14<br>396/428 |
| 2008/0191105 | A1 * | 8/2008 | Bogel | F16M 11/16<br>248/170 |

* cited by examiner

COLLAPSIBLE SUPPORT BASE FOR VERTICAL POSTS

BACKGROUND

1. Technical Field

This disclosure relates generally to a device that acts as a base for vertical or upright posts and other objects that are intended to be secured in a vertical position. More specifically, the device operates collapsible base for vertical signage, posts, Christmas trees, and a host of other objects that is both durable and resistant to forcible impacts.

2. Description of the Related Art

Bases are conventional devices used to support upright or vertical objects. Conventional bases include weight-based bases, closed bases, open bases, tripods/bipods/monopods, and others. Weight-based bases, for example, may be seen in a variety of applications, including lamps, play equipment, such as a tetherball stand, among other applications. The principle of operation for such bases is that instead of driving a post into the ground or physically attaching an object to another object, a base is created in the object providing a substantial amount of weight, relative to the object's total weight sufficient to prevent the object from falling over when situated in an upright position. In one example, a torch-style floor lamp includes a wide weighted base, often filled with sand or water for weight, and a slender upright column portion supporting a light socket within a lamp shade. The width and the weight of the base maintains the column portion, the light socket, and the lamp shade within an upright position. In another example, a tetherball pole may be cemented inside a used tire. The weight of the cement in the width of the tire supports the upright pole such that when a tetherball is attached, the tetherball may be forcefully struck without tipping or knocking over the tetherball pole.

Closed bases are those that allow a post to be inserted into the base, but can extend into the closed base no farther than a bottom installed in the base. For example, typical Christmas tree bases are configured to receive a base of a Christmas tree until the tree rests on the bottom of the base. Clamps are typically installed within the base that push against a trunk of the tree and maintain it in a vertical position. A closed base is particularly appropriate for such an application because it allows a user to place water in the base, which is then absorbed by the tree.

Open bases differ from closed bases. Open bases typically do not include a bottom allowing an object to slide completely through the open base and rest on the ground. An object may then be inserted through a hole in the base and be held in a vertical position by the ground and the base. One example of an open base is a base for an open umbrella. For example, the shaft of an open umbrella may be inserted into a patio table such that the shaft of the umbrella slides completely through the patio table such that an end of the umbrella shaft rests on the ground while being held in a vertical position by the patio table. Open bases do not necessarily support the weight of an object. Rather, open bases typically prevent objects intended to be held vertically from falling by allowing the weight of the object to rest on another surface, such as the ground, and applying only the force required to keep the object in a vertical position.

Another example of conventional bases includes tripods, bipods, and monopods. Each of these bases provides a number of legs that support an object connected, usually, to the top of the legs. For example, tripods are conventionally the most stable of these conventional bases, having three legs, which makes them ideal for use in photography, astronomy, surveying, and spotting. Typically, a camera, a telescope, or a spotting scope may be mounted on top of a tripod. A user may manipulate the legs to adjust the height and the stability of the tripod to capture a particular view through a camera, for example. Bipods are less stable than tripods in that bipods only include two legs, but allow for more simple operation. Bipods are preferable in some situations where a great deal of movement is required, such as when shooting a rifle. Bipods may be mounted to rifles to allow a shooter a wide range of motion while still providing adequate support to the rifle to assist the shooter in making an intended shot. A monopod includes a single leg and is typically not intended to be steady on its own. For example, a leg on a crutch or a cane may be considered a monopod, which is intended to work with another crutch, and one or more of the user's legs to provide support the user needs.

Many of these conventional bases, and others, are inadequately robust to support heavy loads. Further, conventional bases are less resistant to outside impacts than is often desirable. For example, target stand bases are typically wholly inadequate for use as a base to a target stand as they are easily destroyed by the impact of a bullet fired from a firearm. These conventional bases further lack the ability to collapse into smaller more portable forms. Likewise, these conventional bases do not provide rotational adjustment for the legs causing objects that are held vertically to be inadequately supported under some conditions.

It is, therefore, one object of this disclosure to provide a base, which is robust enough to support heavy loads. Another object of this disclosure is to provide a collapsible base that resists damage from object impacting the collapsible base. A further object of this disclosure is to provide a collapsible base that provides one or more pivotable supports to allow the collapsible base to collapse into a smaller more portable form. Finally, an object of this disclosure is to provide pivotable supports that allow rotational adjustment around a circumference of the base.

SUMMARY

Disclosed herein is a support base. The support base includes a support leg that is rigidly joined to a first connector and a second connector. The first connector includes a post aperture while the second connector also includes a second post aperture. The first connector and the second connector further include a plurality of pinning apertures. The support base also includes a pivotable support leg, which includes a pin that is disposed within one of the plurality of pinning apertures in the first connector and within one of the plurality of pinning apertures in the second connector. In this manner, the support base may be collapsible by pivoting or rotating the pivotable support leg towards the support leg.

BRIEF DESCRIPTION OF THE DRAWINGS

The accompanying drawings illustrate an embodiment of collapsible support base for vertical posts.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the rope end safety device disclosed herein. While the techniques and embodiments will primarily be described in context with the accompanying drawings, those skilled in the art will further appreciate the techniques and embodiments may also be practiced in other similar apparatuses.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
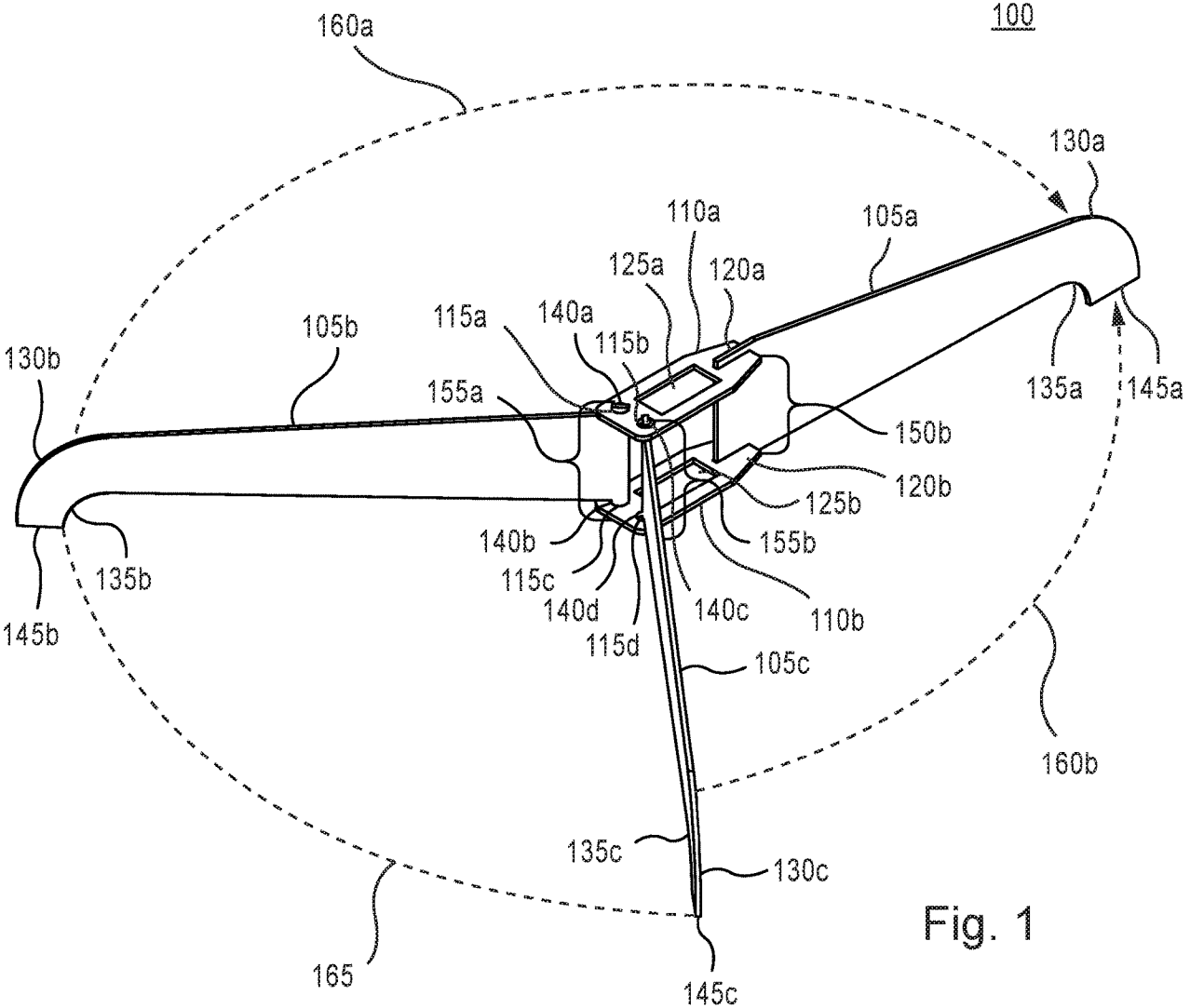
FIG. 1 illustrates a top perspective view of a collapsible support base for vertical posts.

FIG. 1 illustrates a collapsible support base 100 for vertical posts. As used herein, the term "vertical posts" is to be interpreted broadly and may include any object rising from collapsible support base 100. The term "vertical" is not limited to objects, which rise from collapsible support base 100 at only a perpendicular angle to collapsible support base 100. Rather, the term "vertical" is intended to include objects, which may be inserted into collapsible support base 100 and which extend above a topmost surface of collapsible support base 100, in any direction.

Collapsible support base 100 includes support leg 105*a*, support leg 105*b*, and support leg 105*c*. Support leg 105*a* may be permanently attached to a top connector 110*a* and a bottom connector 110*b* using techniques known in the art. Typically collapsible support base 100 may be constructed using hardened steel, such as AR-500 steel or other metals with a Brinell hardness value of 500 or greater. However, it is conceived that other metals may be used such as titanium, aluminum, iron, and other metal alloys. Thus, in many circumstances, support leg 105*a* may be welded to top connector 110*a* and bottom connector 110*b*. Top connector 110*a* includes a first pinning aperture 115*a* and a second pinning aperture 115*b*. Bottom connector 110*b* also includes a first pinning aperture 115*c* and a second pinning aperture 115*d*. Pinning apertures 115*a*-115*d* will be discussed in more detail below.

In one embodiment, support leg 105*a* may be welded into a slot 120*a* disposed within top connector 110*a* and another symmetrical slot 120*b* disposed within bottom connector 110*b*. Slot 120*a* and slot 120*b* allow support leg 105 to be connected to slot 120*a* and slot 120*b* via, for example, joining techniques known in the art, such as welding. Thus, top connector 110*a* and bottom connector 110*b* are permanently rigidly joined to support leg 105*a* by welding support leg 105*a* into slot 120*a* and 120*b*, respectively such that support leg 105*a* does not pivot or rotate. Top connector 110*a* further includes a post aperture 125*a* while bottom connector 110*b* includes a post aperture 125*b*.

Post aperture 125*a* and post aperture 125*b* interface with a vertical post such that the post may be held in a vertical manner. In one embodiment, post aperture 125*a* and post aperture 125*b* may be symmetrical and square relative to each other creating an open type base. In one embodiment, post aperture 125*a* and post aperture 125*b* may be square shaped (e.g., may be equal in both length and width—4 inches by 4 inches), rectangular shaped (e.g., may be longer in length than width—2 inches by 4 inches), circular, wedge shaped, triangular, or any other shape to accommodate a particular implementation. For example, in one embodiment, post aperture 125*a* and post aperture 125*b* may be shaped and sized to accommodate a standard 2 inch by 4 inch piece of lumber (referred to commonly as a "2 by 4"). It should also be noted that a "standard" does not exist with respect to "2 by 4" lumber and many pieces of lumber are not actually two inches by four inches. Notwithstanding, post aperture 125*a* and post aperture 125*b* may be shaped and sized to accommodate both standard and non-standard pieces of "2 by 4" lumber. In another embodiment, post aperture 125*a* and post aperture 125*b* may be wedge shaped to accommodate a particular size of angle iron (e.g., 2" angle iron, having two two-inch pieces of steel joined at a 90° angle relative to each other). In other implementations, post aperture 125*a* and post aperture 125*b* may be polygonal, pentagonal, hexagonal, heptagonal, octagonal, etc. to accommodate various post connectors. One advantage of polygonal shapes for implementation in post aperture 125*a* and post aperture 125*b* is that a post may be rotated at an angle, less than 90°. In some embodiments, where collapsible support base is acting as a base for a firearm target stand, slight rotations of a post, relative to a shooter, may be desirable to reduce the possibility of being struck by a ricochet or may be desirable to simulate a particular training scenario.

Support leg 105*a* extends from a connecting portion of support leg 105*a* outwardly from top connector 110*a* and bottom connector 110*b* at a length suitable for a particular implementation. For example, in some cases, it may be desirable that support leg 105*a* is longer or shorter to provide adequate support for a vertical post of a particular height. However, in each case, support leg 105*a* terminates with an outside radius 130*a*, which essentially turns a top surface of support leg 105*a* 90° towards an outside of foot 145*a*. Support leg 105*a* includes a corresponding inside radius 135*a*, which essentially turns a bottom surface of support leg 105*a* 90° towards an inside of foot 145*a*. Foot 145*a* may rest on top of a surface, such as the ground, or may dig into a surface. For example, collapsible support base 100 may be set up on a surface of earth and foot 145*a* may be driven into the earth to better support a vertical post.

Support leg 105*b* includes a pin top 140*a* and a pin bottom 140*b*, which are disposed in pinning aperture 115*a* and pinning aperture 115*c*, respectively, within top connector 110*a* and bottom connector 110*b*, which will be explained in more detail below. Support leg 105*b* extends outwardly from top connector 110*a* and bottom connector 110*b* at a length suitable for a particular implementation. The connection between support leg 105 and top connector 110*a* and bottom connector 110*b* will be further discussed below. In some cases, it may be desirable that support leg 105*b* is longer or shorter to provide adequate support for a vertical post. However, in each case, support leg 105*b* terminates with an outside radius 130*b*, which essentially turns a top surface of support leg 105*b* 90° towards an outside of foot 145*b*. Support leg 105*b* includes a corresponding inside radius 135*b*, which essentially turns a bottom surface of support leg 105*b* 90° towards an inside of foot 145*b*. Foot 145*b* may rest on top of a surface, such as the ground, or may dig into a surface. For example, collapsible support base 100 may be set up on a surface of earth and foot 145*b* may be driven into the earth to better support a vertical post.

Support leg 105*c* includes a pin top 140*c* and a pin bottom 140*d*, which are disposed in pinning aperture 115*b* and pinning aperture 115*d*, respectively, within top connector 110*a* and bottom connector 110*b*, which will be explained in more detail below. Support leg 105*c* also extends outwardly from top connector 110*a* and bottom connector 110*b* at a length suitable for a particular implementation. The connection between support leg 105*c* and top connector 110*a* and bottom connector 110*b* will be further discussed below. For example, in some cases, it may be desirable that support leg 105*c* is longer or shorter to provide adequate support for a vertical post. However, in each case, support leg 105*c* terminates with an outside radius 130*c*, which essentially turns a top surface of support leg 105*c* 90° towards an outside of foot 145*c*. Support leg 105*c* includes a corresponding inside radius 135*c*, which essentially turns a bottom surface of support leg 105*c* 90° towards an inside of foot 145*c*. Foot 145*c* may rest on top of a surface, such as the ground, or may dig into a surface. For example, collapsible support base 100 may be set up on a surface of earth and foot 145*c* may be driven into the earth to better support a vertical post.

Top connector 110*a* and bottom connector 110*b* may be spaced apart from each other at a first distance 150. For example, when support leg 105*a* is welded to top connector 110*a* via slot 120*a*, bottom connector 110*b* may be welded to support leg 105*a* at a first distance 150 away. First distance 150, may therefore be the distance along a connecting portion of support leg 105*a* between a top of top connector 110*a* and a bottom of bottom connector 110*b*. First distance 150 may be equal to or less than a length 155*a* of support leg 105*b* between a top of pin top 140*a* and a bottom of pin bottom 140*b*. Similarly, first distance 150 may be equal to or less than a length 155*b* of support leg 105*c* between a top of pin top 140*c* and a bottom of pin bottom 140*d*. In this manner, support leg 105*b* and support leg 105*c* are pinned in place by pin apertures 115*a-d* disposed within top connector 110*a* and bottom connector 110*b*.

Accordingly, collapsible support base 100 may be constructed by disposing pin top 140*a* of support leg 105*b* within pin aperture 115*a* of top connector 110*a* and pin bottom 140*b* of support leg 105*b* within pin aperture 115*c* of bottom connector 110*b*. Then, pin top 140*b* of support leg 105*c* may be disposed within pin aperture 115*b* of top connector 110*a* and pin bottom 140*d* of support leg 105*c* may be disposed within pin aperture 115*d* of bottom connector 110*b*. At this point, first distance 150 may be set by joining bottom connector 110*b* at slot 120*b* to support leg 105*a* and by joining top connector 110*a* at slot 120*a* to support leg 105*a*. When top connector 110*a* and bottom connector 110*a* are joined with support leg 105*a*, distance 150 being less than the length 155*a* of support leg 105*b* and length 155*b* of support leg 105*c*, support leg 105*b* and support leg 105*c* are pivotably trapped by pin apertures 115*a*-115*d* within top connector 110*a* and bottom connector 110*b*.

In this manner, support leg 105*b* may rotate along an axis 160*a*, which effectively allows support leg 105*b* to rotate to a position that is virtually parallel with support leg 105*a*. Similarly, support leg 105*c* may rotate along an axis 160*b*, which effectively allows support leg 105*c* to rotate to a position that is virtually parallel with support leg 105*a*. Thus, when support leg 105*b* and support leg 105*c* are rotated to a position that is virtually parallel to support leg 105*a*, collapsible support base 100 is collapsed into a much smaller and much more portable form. Further, support leg 105*b* and support leg 105*c* when in an operating position (i.e., an un-collapsed position), may be positioned anywhere along axis 160*a* and axis 165. Axis 165 is an axis defined as being the range of motion for support leg 105*b* towards support leg 105*c* and the range of motion for support leg 105*c* towards support leg 105*b*. In other words, the rotational movement of support leg 105*b* may be bounded approximately by support leg 105*a* and a point where support leg 105*b* is stopped by touching support leg 105*c* between top pin 115*b* and bottom pin 115*d*. Similarly, support leg 105*c* may be positioned anywhere along axis 160*b* and axis 165. In other words, the rotational movement of support leg 105*c* may be bounded approximately by support leg 105*a* and a point where support leg 105*c* is stopped by touching support leg 105*b* between top pin 115*a* and bottom pin 115*c*. In this manner, at least one of support legs 105*b* and 105*c* may be positioned virtually anywhere in a 360 degree arc. A desirable implementation, however, positions support leg 105*b* and support leg 105*c* at approximately 120° from each other and from support leg 105*a*.

It is also noted that collapsible support base 100 may include additional support legs. For example, top connector 110*a* and bottom connector 110*b* may be elongated to include several additional post apertures in addition to post aperture 125 and post aperture 125*b*, accommodating several posts in a side by side fashion. In some embodiments, when top connector 110*a* and bottom connector 110*b* are elongated, it may be desirable to add one or more additional support legs, which may be pinned into additional apertures disposed in both top connector 110*a* and bottom connector 110*b* to provide additional support for the elongated connectors using the techniques described herein.

Figure 2:
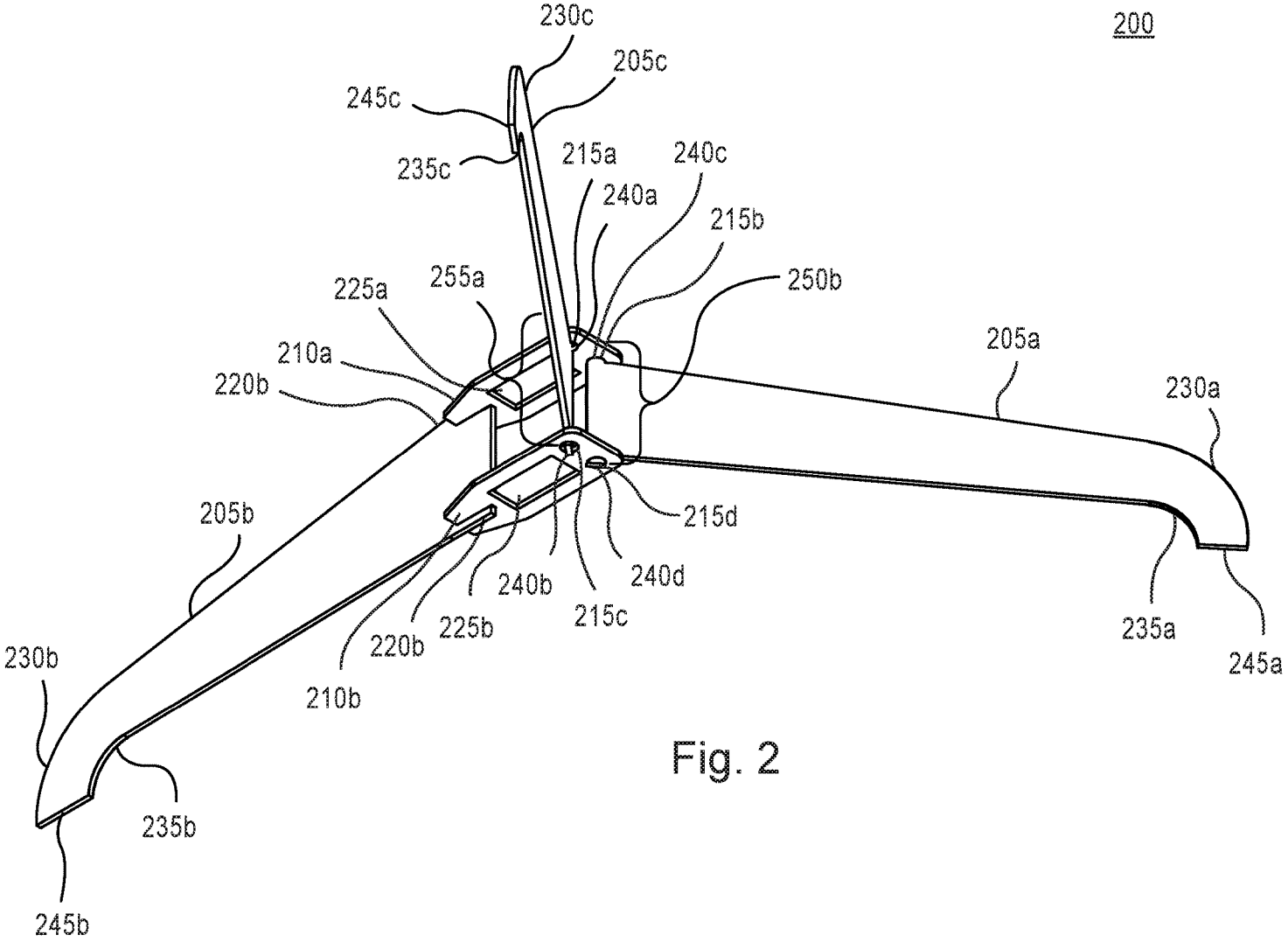
FIG. 2 illustrates a bottom perspective view of a collapsible support base for vertical posts.

FIG. 2 illustrates bottom perspective view of a collapsible support base 200 for vertical posts. Collapsible support base 200 is similar in implementation and description to collapsible support base 100, shown in FIG. 1. Collapsible support base 200 includes support leg 205*a*, support leg 205*b*, and support leg 205*c*. Support leg 205*a* may be permanently attached to a top connector 210*a* and a bottom connector 210*b* using techniques known in the art. Typically collapsible support base 200 may be constructed using hardened steel, such as AR-500 steel or other metals with a Brinell hardness value of 500 or greater. However, it is conceived that other metals may be used such as titanium, aluminum, iron, and other metal alloys. Thus, in many circumstances, support leg 205*a* may be welded to top connector 210*a* and bottom connector 210*b*. Top connector 210*a* includes a first pinning aperture 215*a* and a second pinning aperture 215*b*. Bottom connector 210*b* also includes a first pinning aperture 215*c* and a second pinning aperture 215*d*. Pinning apertures 215*a*-215*d* will be discussed in more detail below.

In one embodiment, support leg 205*a* may be welded into a slot 220*a* disposed within top connector 210*a* and another symmetrical slot 220*b* disposed within bottom connector 210*b*. Slot 220*a* and slot 220*b* allow support leg 205 to be connected to slot 220*a* and slot 220*b* via, for example, joining techniques known in the art, such as welding. Thus, top connector 210*a* and bottom connector 210*b* are permanently joined to support leg 205*a* by welding support leg

205*a* into slot 220*a* and 220*b*, respectively. Top connector 210*a* further includes a post aperture 225*a* while bottom connector 210*b* includes a post aperture 225*b*.

Post aperture 225*a* and post aperture 225*b* interface with a vertical post such that the post may be held in a vertical manner. In one embodiment, post aperture 225*a* and post aperture 225*b* may be symmetrical and square relative to each other, creating an open type base. In one embodiment, post aperture 225*a* and post aperture 225*b* may be square shaped (e.g., may be equal in both length and width—4 inches by 4 inches), rectangular shaped (e.g., may be longer in length than width—2 inches by 4 inches), circular, wedge shaped, triangular, or any other shape to accommodate a particular implementation. For example, in one embodiment, post aperture 225*a* and post aperture 225*b* may be shaped and sized to accommodate a standard 2 inch by 4 inch piece of lumber (referred to commonly as a "2 by 4"). It should also be noted that a "standard" does not exist with respect to "2 by 4" lumber and many pieces of lumber are not actually two inches by four inches. Notwithstanding, post aperture 225*a* and post aperture 225*b* may be shaped and sized to accommodate both standard and non-standard pieces of "2 by 4" lumber. In another embodiment, post aperture 225*a* and post aperture 225*b* may be wedge shaped to accommodate a particular size of angle iron (e.g., 2" angle iron, having two two-inch pieces of steel joined at a 90° angle relative to each other). In other implementations, post aperture 225*a* and post aperture 225*b* may be polygonal, pentagonal, hexagonal, heptagonal, octagonal, etc., to accommodate various post connectors. One advantage of polygonal shapes for implementation in post aperture 225*a* and post aperture 225*b* is that a post may be rotated at an angle, less than 90°. In some embodiments, where collapsible support base is acting as a base for a firearm target stand, slight rotations of a post, relative to a shooter, may be desirable to reduce the possibility of being struck by a ricochet or may be desirable to simulate a particular training scenario.

Support leg 205*a* extends from a connecting portion of support leg 205*a* outwardly from top connector 210*a* and bottom connector 210*b* at a length suitable for a particular implementation. For example, in some cases, it may be desirable that support leg 205*a* is longer or shorter to provide adequate support for a vertical post of a particular height. However, in each case, support leg 205*a* terminates with an outside radius 230*a*, which essentially turns a top surface of support leg 205*a* 90° towards an outside of foot 245*a*. Support leg 205*a* includes a corresponding inside radius 235*a*, which essentially turns a bottom surface of support leg 205*a* 90° towards an inside of foot 245*a*. Foot 245*a* may rest on top of a surface, such as the ground, or may dig into a surface. For example, collapsible support base 200 may be set up on a surface of earth and foot 245*a* may be driven into the earth to better support a vertical post.

Support leg 205*b* includes a pin top 240*a* and a pin bottom 240*b*, which are disposed in pinning aperture 215*a* and pinning aperture 215*c*, respectively, within top connector 210*a* and bottom connector 210*b*, which will be explained in more detail below. Support leg 205*b* extends outwardly from top connector 210*a* and bottom connector 210*b* at a length suitable for a particular implementation. The connection between support leg 205 and top connector 210*a* and bottom connector 210*b* will be further discussed below. In some cases, it may be desirable that support leg 205*b* is longer or shorter to provide adequate support for a vertical post. However, in each case, support leg 205*b* terminates with an outside radius 230*b*, which essentially turns a top surface of support leg 205*b* 90° towards an outside of foot 245*b*. Support leg 205*b* includes a corresponding inside radius 235*b* which essentially turns a bottom surface of support leg 205*b* 90° towards an inside of foot 245*b*. Foot 245*b* may rest on top of a surface, such as the ground, or may dig into a surface. For example, collapsible support base 200 may be set up on a surface of earth and foot 245*b* may be driven into the earth to better support a vertical post.

Support leg 205*c* includes a pin top 240*c* and a pin bottom 240*d* which are disposed in pinning aperture 215*b* and pinning aperture 215*d*, respectively, within top connector 210*a* and bottom connector 210*b*, which will be explained in more detail below. Support leg 205*c* also extends outwardly from top connector 210*a* and bottom connector 210*b* at a length suitable for a particular implementation. The connection between support leg 205*c* and top connector 210*a* and bottom connector 210*b* will be further discussed below. For example, in some cases, it may be desirable that support leg 205*c* is longer or shorter to provide adequate support for a vertical post. However, in each case, support leg 205*c* terminates with an outside radius 230*c*, which essentially turns a top surface of support leg 205*c* 90° towards an outside of foot 245*c*. Support leg 205*c* includes a corresponding inside radius 235*c*, which essentially turns a bottom surface of support leg 205*c* 90° towards an inside of foot 245*c*. Foot 245*c* may rest on top of a surface, such as the ground, or may dig into a surface. For example, collapsible support base 200 may be set up on a surface of earth and foot 245*c* may be driven into the earth to better support a vertical post.

Top connector 210*a* and bottom connector 210*b* may be spaced apart from each other at a first distance 250. For example, when support leg 205*a* is welded to top connector 210*a* via slot 220*a*, bottom connector 210*b* may be welded to support leg 205*a* at a first distance 250 away. First distance 250, may therefore be the distance along a connecting portion of support leg 205*a* between a top of top connector 210*a* and a bottom of bottom connector 210*b*. First distance 250 may be equal to or less than a length 255*a* of support leg 205*b* between a top of pin top 240*a* and a bottom of pin bottom 240*b*. Similarly, first distance 250 may be equal to or less than a length 255*b* of support leg 205*c* between a top of pin top 240*c* and a bottom of pin bottom 240*d*. In this manner, support leg 205*b* and support leg 205*c* are pinned in place by pin apertures 215*a-d* disposed within top connector 210*a* and bottom connector 210*b*.

Accordingly, collapsible support base 200 may be constructed by disposing pin top 240*a* of support leg 205*b* within pin aperture 215*a* of top connector 210*a* and pin bottom 240*b* of support leg 205*b* within pin aperture 215*c* of bottom connector 210*b*. Then, pin top 240*b* of support leg 205*c* may be disposed within pin aperture 215*b* of top connector 210*a* and pin bottom 240*d* of support leg 205*c* may be disposed within pin aperture 215*d* of bottom connector 210*b*. At this point, first distance 250 may be set by joining bottom connector 210*b* at slot 220*b* to support leg 205*a* and by joining top connector 210*a* at slot 220*a* to support leg 205*a*. When top connector 210*a* and bottom connector 210*a* are joined with support leg 205*a*, distance 250 being less than the length 255*a* of support leg 205*b* and length 255*b* of support leg 205*c*, support leg 205*b* and support leg 205*c* are pivotably trapped by pin apertures 215*a*-215*d* within top connector 210*a* and bottom connector 210*b*.

It is also noted that collapsible support base 200 may include additional support legs. For example, top connector 210*a* and bottom connector 210*b* may be elongated to include several additional post apertures in addition to post aperture 225 and post aperture 225*b*, accommodating several posts in a side by side fashion. In some embodiments, when top connector 210*a* and bottom connector 210*b* are elongated, it may be desirable to add one or more additional support legs, which may be pinned into additional apertures disposed in both top connector 210*a* and bottom connector 210*b* to provide additional support for the elongated connectors using the techniques described herein.

Figure 3:
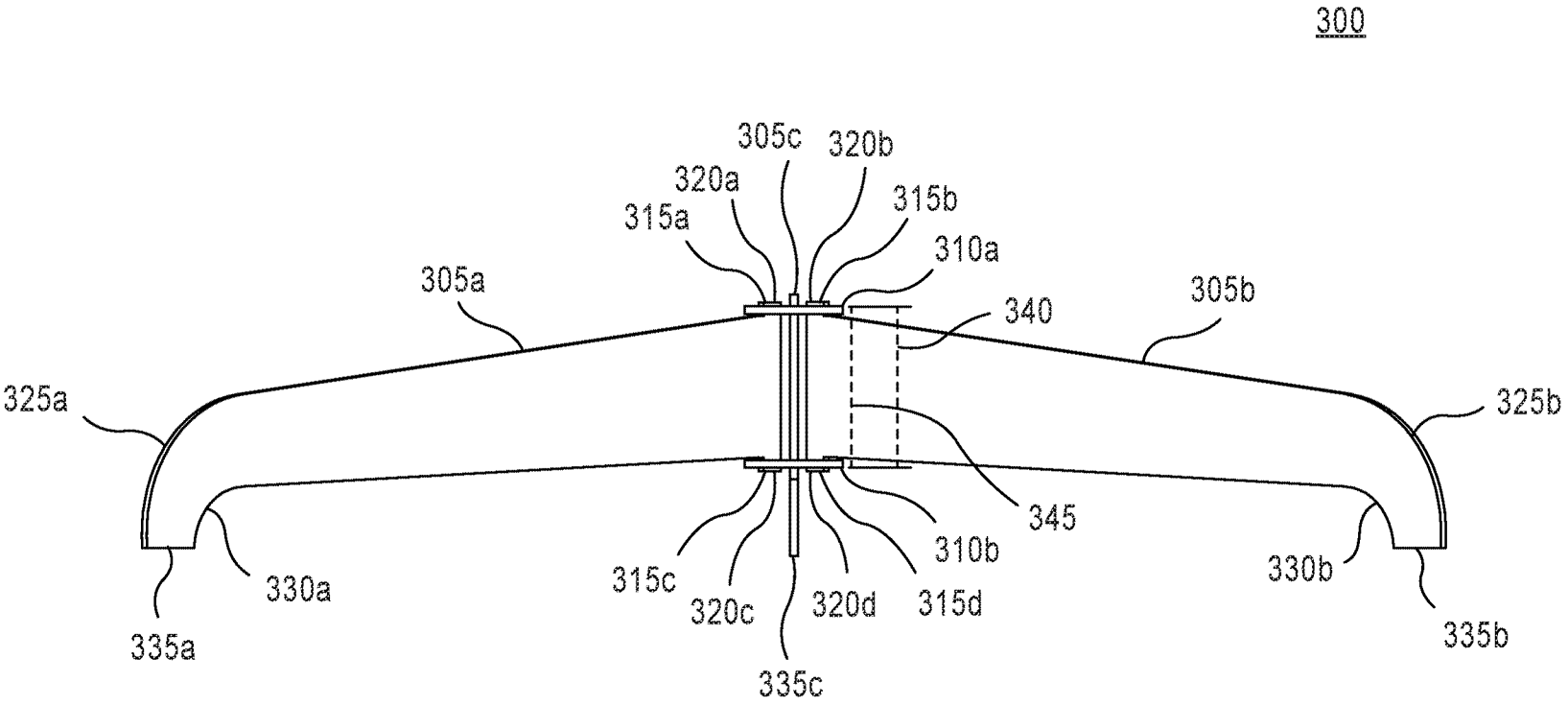
FIG. 3 illustrates a side view of a collapsible support base for vertical posts.

FIG. 3 illustrates a side view of collapsible support base 300 for vertical posts. Collapsible support base 300 may be similar in implementation and description to collapsible support base 100 shown in FIG. 1 and collapsible support base 200 shown in FIG. 2. As shown in FIG. 3, a support leg 305*a*, (which is analogous to support leg 105*a* shown in FIG. 1, for example) is provided in collapsible support base 300. Collapsible support base 300 further includes a support leg 305*b*, (which is analogous to support leg 105*c* shown in FIG. 1, for example.) Thus, the view of collapsible support base 300 shown in FIG. 3 is a side view looking into a pinning structure such that only a foot 335*c* of support leg 305*c* that is analogous to support leg 105*a* of FIG. 1 is visible.

Support leg 305*a* and support leg 305*b* are connected to top connector 310*a* and bottom connector 310*b*. Top connector 310*a* includes a pinning aperture 315*a* and a pinning aperture 315*b*. Bottom connector 310*b* includes a pinning aperture 315*c* and a pinning aperture 315*b*. Support leg 305*a* includes a top pin 320*a* and bottom pin 320*c*, which may be disposed within pinning aperture 315*a* of top connector 310*a* and pinning aperture 315*c* of bottom connector 310*b*. Similarly, support leg 305*b* includes a top pin 320*b* and bottom pin 320*d*, which may be disposed within pinning aperture 315*b* of top connector 310*a* and pinning aperture 315*d* of bottom connector 310*b*, as will be further discussed below.

Support leg 305*a* extends from top connector 310*a* and bottom connector 310*b* at a length suitable to support a particular vertical post. Support leg 305*a* terminates with an outside radius 325*a*, which essentially turns a top surface of support leg 305*a* 90° towards an outside of foot 335*a* and an inside radius 330*a* which essentially turns a bottom surface of support leg 305*a* 90° towards an inside of foot 335*b*. Similarly, support leg 305*b* extends from top connector 310*a* and bottom connector 310*b* at a length substantially equal to the length of support leg 305*a* and support leg 305*c*, which is suitable to support a particular vertical post. Support leg 305*b* terminates with an outside radius 325*b*, which essentially turns a top surface of support leg 305*b* towards an outside of foot 335*b* and an inside radius 330*b*, which essentially turns a bottom surface of support leg 305*b* 90° towards an inside of foot 335*b*. Foot 335*a*, foot 335*b*, and foot 335*c* may rest on top of a surface, such as the ground, or may dig into a surface. For example, collapsible support base 300 may be set up on a surface of earth and foot 335*a*, foot 335*b*, and foot 335*c* may be driven into the earth to better support a vertical post.

Top connector 310*a* and bottom connector 310*b* may be a set distance 150 apart from each other by joining top connector 310*a* and bottom connector 310*b* at distance 150 along a connecting portion of support leg 305*c*. Distance 150 may be defined as the distance between the top of top connector 310*a* and the bottom of bottom connector 310*b*. Top pin 320*a* of support leg 305*a* may be disposed in pinning aperture 315*a* of top connector 310*a* while bottom pin 320*c* of support leg 305*a* may be disposed in pinning aperture 315*b* of bottom connector 310*b*. Further, in one embodiment, a length 345 between the top of top pin 320*a* and the bottom pin 320*c* may be equal to or greater than distance 150. Similarly, top pin 320*b* of support leg 305*b* may be disposed in pinning aperture 315*b* of top connector 310*a* while bottom pin 320*d* of support leg 305*a* may be disposed in pinning aperture 315*d* of bottom connector 310*b*. In this manner, support leg 305*a* and support leg 305*b* may be pinned into or trapped within top connector 310*a* and bottom connector 310*b*. When top connector 310*a* and bottom connector 310*b* are permanently joined to support leg 305*c* at distance 150, support leg 305*a* and support leg 305*b* are effectively rotatably pinned within pinning apertures within top connector 310*a* and bottom connector 310*b*. Because length 340 between a top of top pin 320*a* and a bottom of bottom pin 320*c* (or a top of top pin 320*a* and a bottom of bottom pin 320*d*) is greater than or equal to distance 345 between top connector 310*a* and bottom connector 310*b*, support leg 305*a* (and support leg 305*b*) are permanently disposed within pinning aperture 315*a* (or pinning aperture 315*b*) and pinning aperture 315*c* (or pinning aperture 315*d*). Thus, support leg 305*a* and support leg 305*b* may rotate by the pinned connection between support leg 305*a*, support leg 305*b*, top connector 310*a* and bottom connector 310*b*.

Figure 4:
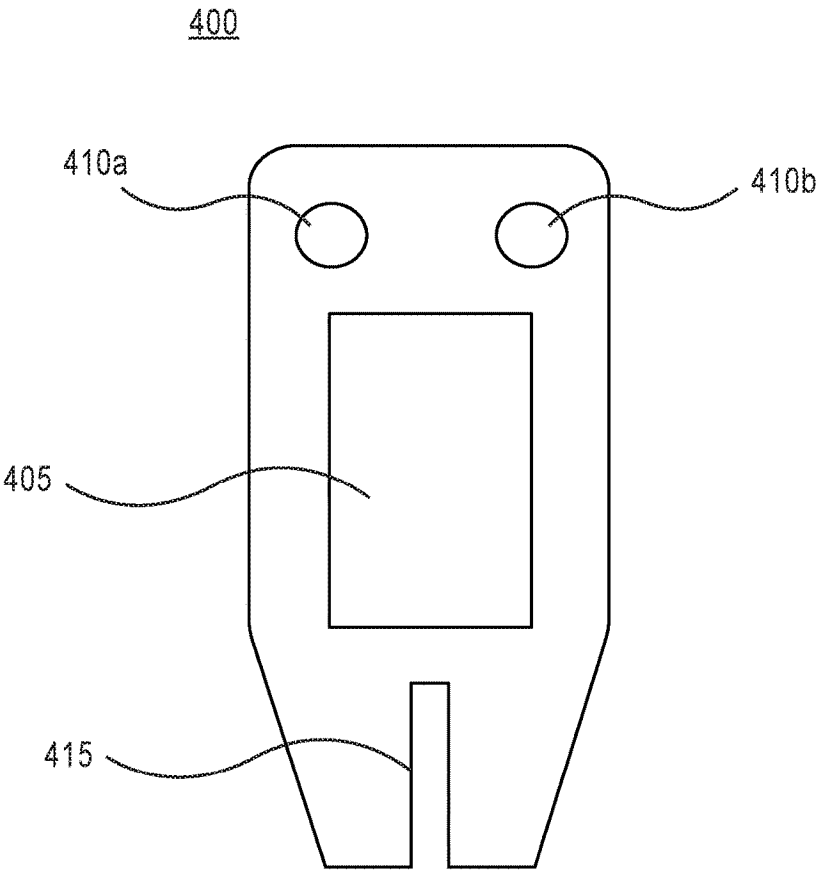
FIG. 4 illustrates a connector for a collapsible support base for vertical posts.

FIG. 4 illustrates a connector 400 for a collapsible support base for vertical posts, shown and discussed above with respect to FIGS. 1-3. Connector 400 may be implemented in a manner similar in implementation and description to top connector 110*a* and bottom connector 110*b*, top connector 210*a* and bottom connector 210*b*, and top connector 310*a* and bottom connector 310*b* shown and described above. Connector 400 includes a post aperture 405, which receives an object to be supported vertically by a collapsible support base. Connector 400 further includes a first pinning aperture 410*a* and a second pinning aperture 410*b*. First pinning aperture 410*a* and second pinning aperture 410*b* may receive a pin attached to a support leg and secure the pin within either first pinning aperture 410*a* or second pinning aperture 410*b*. Connector 400 may further include a slot 415 for receiving a connecting portion of a support leg. The connecting portion of a support leg may be permanently joined, by welding, for example, with connector 400 by inserting the connecting portion of the support leg into slot 415 and joining them.

Figure 5:
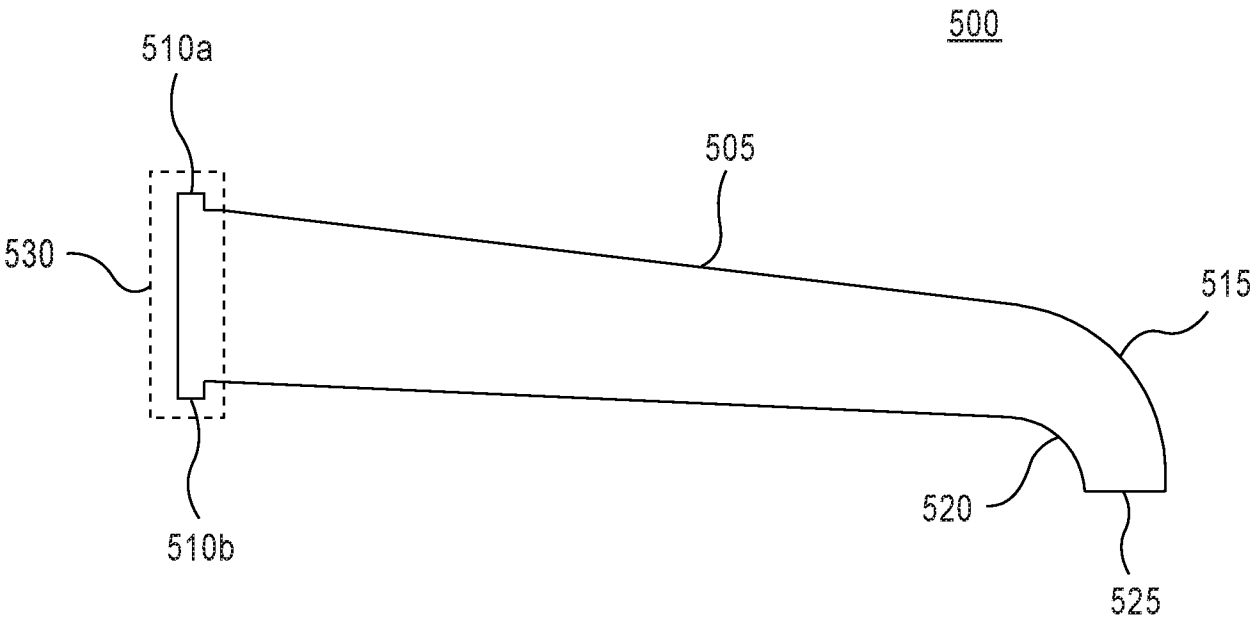
FIG. 5 illustrates support leg for a collapsible support base for vertical posts.

FIG. 5 illustrates support leg 500 for a collapsible support base for vertical posts. Support leg 500 includes an extension portion 505, which extends support leg 500 away from top pin 510*a* and bottom pin 510*b* at a distance sufficient to support an object attached to the collapsible support base in an upright or vertical position. Support leg 500 terminates with an outside radius 515, which essentially turns a top surface of support leg 505 90° towards an outside of foot 525. Support leg 500 includes a corresponding inside radius 520, which essentially turns a bottom surface of support leg 500 90° towards an inside of foot 525. Foot 525 may rest on top of a surface, such as the ground, or may dig into a surface. For example, the collapsible support base may be set up on a surface of earth and foot 525 may be driven into the earth to better support a vertical post.

Support leg 500 further includes a pin portion 530, which extends at a desired with, terminating at pin top 510*a* and pin bottom 510*b*. Pin portion 530 acts as a pin, which may be disposed in, for example, pin apertures in a connector, as shown and described above. In one embodiment, pin top 510*a* and pin bottom 510*b* may be rounded to facilitate rotating within a pin aperture. In another embodiment, pin top 510*a* and pin bottom 510*b* may be essentially flat. In this manner, support leg 500, including pin top 510*a*, pin bottom

510*b*, and pin portion 530 may simply be cut from a flat piece of hardened steel without substantially rounding pin top 510*a* and pin bottom 510*b*.

The foregoing description is presented for purposes of illustration. It is not exhaustive and does not limit the invention to the precise forms or embodiments disclosed. Modifications and adaptations are apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A support base, comprising:

a support leg rigidly joined to a first connector having a first post aperture and rigidly joined to a second connector having a second post aperture, wherein the first connector and the second connector include a plurality of pinning apertures and wherein the first connector includes a first slot that receives the support leg and the second connector includes a second slot that receives the support leg;

a pivotable support leg including a pin portion which is integral to the pivotable support leg and provides a pin top and a pin bottom which are respectively disposed within one of the plurality of pinning apertures in the first connector and one of the pinning apertures in the second connector; and another pivotable support leg including a pin portion which is integral to the another pivotable support leg and provides a pin top and a pin bottom which are respectively disposed within one of the plurality of pinning apertures in the first connector and another one of the pinning apertures in the second connector.

2. The support base of claim 1, wherein the pin portion is longer between the pin bottom and the pin top than a distance between the first connector and the second connector.

3. The support base of claim 1, wherein the pin portion is as long between the pin bottom and the pin top as the distance between the first connector and the second connector.

4. The support base of claim 1, wherein the support leg, the first connector, the second connector, and the pivotable support leg are constructed from steel with a Brinell Hardness value exceeding 500.

5. The support base of claim 1, wherein the support leg extends from the first connector and the second connector and turns a top surface of the support leg 90° to an outside of a foot.

6. The support base of claim 5, wherein the support leg extends from the first connector and the second connector and turns a bottom surface of the support leg 90° to an inside of a foot.

7. The support base of claim 1, wherein the pivotable support leg extends from the first connector and the second connector and turns a top surface of the support leg 90° to an outside of a foot.

8. The support base of claim 7, wherein the pivotable support leg extends from the first connector and the second connector and turns a bottom surface of the support leg 90° to an inside of a foot.

9. The support base of claim 1, wherein the another pivotable support leg extends from the first connector and the second connector and turns a top surface of the support leg 90° to an outside of a foot.

10. The support base of claim 9, wherein the another pivotable support leg extends from the first connector and the second connector and turns a bottom surface of the support leg 90° to an inside of a foot.

11. The support base of claim 1, wherein the support base of claim 1 is collapsible.

12. The support base of claim 11, wherein the pivotable support leg rotates into physical contact with the support leg.

13. The support base of claim 1, wherein the first post aperture is square.

14. The support base of claim 1, wherein the first post aperture is rectangular.

15. The support base of claim 1, wherein the first post aperture is circular.

16. A support base, comprising:

a support leg rigidly joined to a first slot provided in a first connector and second slot provided in a second connector;

a pivotable support leg, including a first pin which is integral to the pivotable support leg and which is pinned into a first aperture in the first connector and a first aperture in the second connector; and another pivotable support leg, including a second pin which is integral to the another pivotable support leg and which is pinned into a second aperture in the first connector and a second aperture in the second connector.

17. The support base of claim 16, further comprising: a post aperture in the first connector.

18. The support base of claim 16, wherein the first slot in the first connector and the second slot in the second connector are fixed at a distance by the rigid joining of the first connector to the support leg and the rigid joining of the second connector to the support leg and wherein the distance is shorter than a length of the first pin and a length of the second pin.

* * * * *